US008152028B2

(12) United States Patent
Migliorati

(10) Patent No.: US 8,152,028 B2
(45) Date of Patent: Apr. 10, 2012

(54) ACTIVATION AND FLUIDIFICATION SYSTEM FOR GRANULAR MATERIAL SILOS AND CONTAINERS

(75) Inventor: Genio Migliorati, Bergamo (IT)

(73) Assignee: Larix S. R. L., Bergamo (IT)

( * ) Notice: Subject to any disclaimer, the term of this patent is extended or adjusted under 35 U.S.C. 154(b) by 408 days.

(21) Appl. No.: 12/430,143

(22) Filed: Apr. 27, 2009

(65) Prior Publication Data

US 2009/0272829 A1 Nov. 5, 2009

(30) Foreign Application Priority Data

May 5, 2008 (IT) ..... BG2008A0028

(51) Int. Cl.
*B65G 69/06* (2006.01)
*B65G 53/40* (2006.01)
*B65G 53/38* (2006.01)

(52) U.S. Cl. ..... 222/195; 406/136; 406/137

(58) Field of Classification Search ..... 222/3, 195, 222/460–462, 630; 406/134, 136, 137
See application file for complete search history.

(56) References Cited

U.S. PATENT DOCUMENTS

| | | | | | |
|---|---|---|---|---|---|
| 2,115,023 | A * | 4/1938 | Kennedy et al. | ..... | 406/137 |
| 3,671,079 | A * | 6/1972 | Huffaker | ..... | 406/137 |
| 4,400,131 | A * | 8/1983 | Blake | ..... | 414/491 |
| 4,449,644 | A * | 5/1984 | Matson | ..... | 222/3 |
| 4,826,051 | A * | 5/1989 | Milian | ..... | 222/195 |
| 5,106,240 | A * | 4/1992 | Dirkse et al. | ..... | 406/138 |
| 2008/0279641 | A1 * | 11/2008 | Critelli | ..... | 406/137 |

FOREIGN PATENT DOCUMENTS

| | | | |
|---|---|---|---|
| DE | 197 43 789 | A1 | 4/1999 |
| DE | 20 2006 016 627 | U1 | 12/2006 |
| JP | 60-157424 | A | 8/1985 |
| WO | 2008/009337 | A1 | 1/2008 |

OTHER PUBLICATIONS

European Search Report in respect of EP Application No. 09 00 5811.
Patent Abstracts of Japan English abstract of JP 60-157424 A.

* cited by examiner

*Primary Examiner* — Darren W Gorman
(74) *Attorney, Agent, or Firm* — Ladas & Parry LLP

(57) ABSTRACT

An activation and fluidification system (100) for granular material silos (101) or containers, comprising a plurality of fine adjustment firing valves (102) comprising discharge limiters to limit the discharge of a pressurized aeriform from an initial pressure to a predetermined final pressure lower than the initial pressure, and connected to the silo (101), the system comprising a tubular network (103) for storing pressurized aeriform at the initial pressure, and to which the plurality of valves (102) are connected.

9 Claims, 4 Drawing Sheets

ACTIVATION AND FLUIDIFICATION SYSTEM FOR GRANULAR MATERIAL SILOS AND CONTAINERS

BACKGROUND OF THE INVENTION

1. Field of the Invention

The present invention relates to an activation and fluidification system for granular material silos and containers.

2. Description of the Technical Background

The system can also be applied to conduits at temperature, such as hot conduits for preheating lines in cement works, or to remove deposits within ducts of fume and dust suction plants, and in all cases where a virtually instantaneous air jet is required.

In the state of the art, preparation of cements and agglomerates of various types, granular and pulverulent materials fed from hoppers are used. Granular materials can also be involved in many other cases of the art, for example in silos.

These materials often tend to undergo compaction and form solid flakes which hinder or indeed prevent material outflow.

These solid flakes are generally disintegrated and their constituent material fluidified using powerful jets of air or other gases by the so-called "firing" technique.

This technique almost instantaneously introduces a large quantity of compressed gas at high pressure into the vicinity of these solid flakes, to product impact waves which disintegrate them.

The gas quantity introduced must be such as to completely disperse its kinetic energy into the material present in the silo or hopper.

Firing valves enable a certain quantity of air at high pressure to be injected instantaneously.

To ensure this, an air reservoir fed by a compressed air circuit is directly connected to each valve.

As many as some tens of valves and relative storage reservoirs are typically required in one silo.

SUMMARY OF THE INVENTION

The Applicant has realized that in firing valves, only the high pressure part of the outflow is important for the purpose to be achieved. The low pressure tail represents only a loss of air which has to be made up.

Hence, the useful energy of the air used for firing, air which is normally stored in a reservoir adjacent to the valve, regards the initial impact wave pulse at maximum pressure, between 5 and 10 bar, whereas the firing tail, below 5 bar, has no practical effect and represents a loss, considering that this tail is also reloaded into the reservoir to restore initial conditions.

To solve this wastage problem, fine adjustment firing valves have been conceived which enable the air discharge to be limited to the attainment of a pressure established by a pressure setting device.

DETAILED DESCRIPTION OF THE INVENTION

Figure 1:
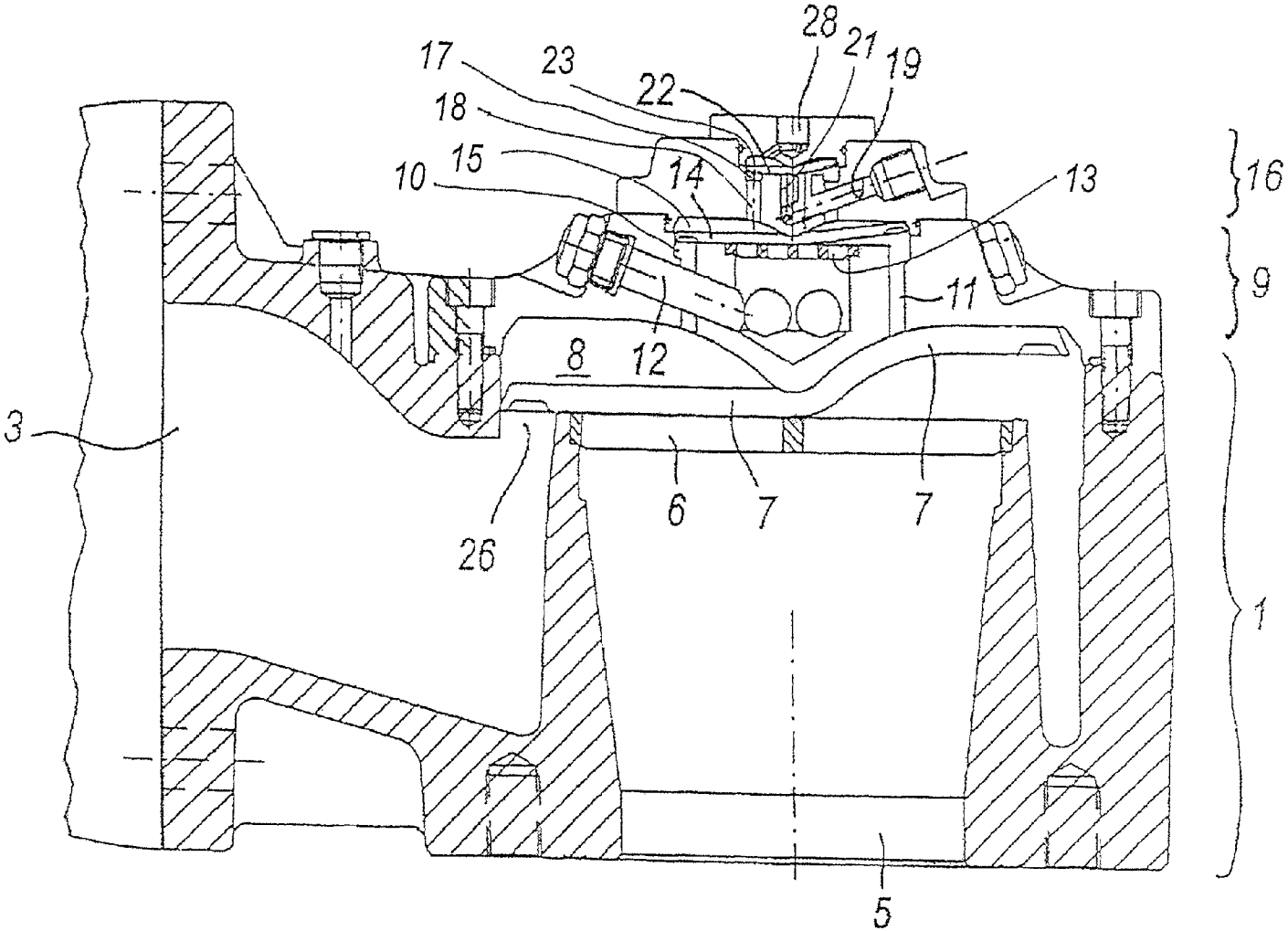
FIG. 1 is a cross section view of a fine adjustment firing valve suitable for use in the present invention.

With reference to FIG. 1, the fine adjustment firing valve for rapid compressed air or gas discharge, for the purpose of generating a pressure wave in granular material silos or containers, comprises a main pneumatic valve 1 presenting a valve body with an inlet 3 and outlet 5 connected together by a main actuation chamber 8, a main access 26 connecting the inlet 3 to the main actuation chamber 8, a main port 6 connecting the main actuation chamber 8 to the outlet 5, said main valve 1 also comprising a main valving element 7, adapted to move within said main actuation chamber 8 to alternately connect the inlet 3 to the outlet 5 or the inlet 3 to a first connection conduit 11 which opens into the main actuation chamber 8, said firing valve further comprising a secondary pneumatic valve 9 controlling the main valve 1 by acting on said main valving element 7, and comprising a secondary actuation chamber 15, of smaller volume than the main actuation chamber 8, connected by said first connection conduit 11 to the main actuation chamber 8, a secondary outlet 12 connected to the secondary actuation chamber 15, a secondary access 10 connecting the first connection conduit 11 to the secondary actuation chamber 15, a secondary port 13 connecting the secondary actuation chamber 15 to the secondary outlet 12, said secondary valve 9 further comprising a secondary valving element 14 of membrane type adapted to move within said secondary actuation chamber 15 to alternately connect the first connection conduit 11 to the secondary outlet 12 or the first connection conduit 11 to a second connection conduit 18 which opens into the secondary actuation chamber 15, said firing valve further comprising a pilot valve 16 controlling the secondary valve 9 by acting on said secondary valving element 14 via said second connection conduit 18, said main valving element 7 being a membrane.

Said pilot valve 16 presents a pilot actuation chamber 23 of smaller volume than the secondary actuation chamber 15 and connected via said second connection conduit 18 to the secondary actuation chamber 15, a pilot outlet 19 connected to the pilot actuation chamber 23, a pilot access 17 connecting the second connection conduit 18 to the pilot actuation chamber 23, a pilot port 21 connecting the pilot actuation chamber 23 to the pilot outlet 19, said pilot valve 16 further comprising a pilot valving element 22 of membrane type adapted to move within said pilot actuation chamber 23 to alternately connect the second connection conduit 18 to the pilot outlet 19 or the second connection conduit 18 to an operating conduit 28 which opens into the pilot actuation chamber 23.

This valve has four accesses to the outside, namely an inlet 3, a outlet 5, a pilot outlet 19, and an operating conduit 28.

The described valve is completely mechanical and/or pneumatic. As an alternative, electrically controlled valves can be used, where the valve opening and closure time is determined by a control unit, on the basis of the pressure measured by a pressure transmitter.

The Applicant has appreciated that by virtue of this type of valve, a firing system based on new assumptions can be structured.

The object of the present invention is therefore to provide an activation and fluidification system for loose siloed materials, comprising a firing valve system of simpler construction and greater effectiveness.

This object is attained by an activation and fluidification system for granular material silos or containers, the inventive characteristics of which are defined by the accompanying claims.

Figure 2:
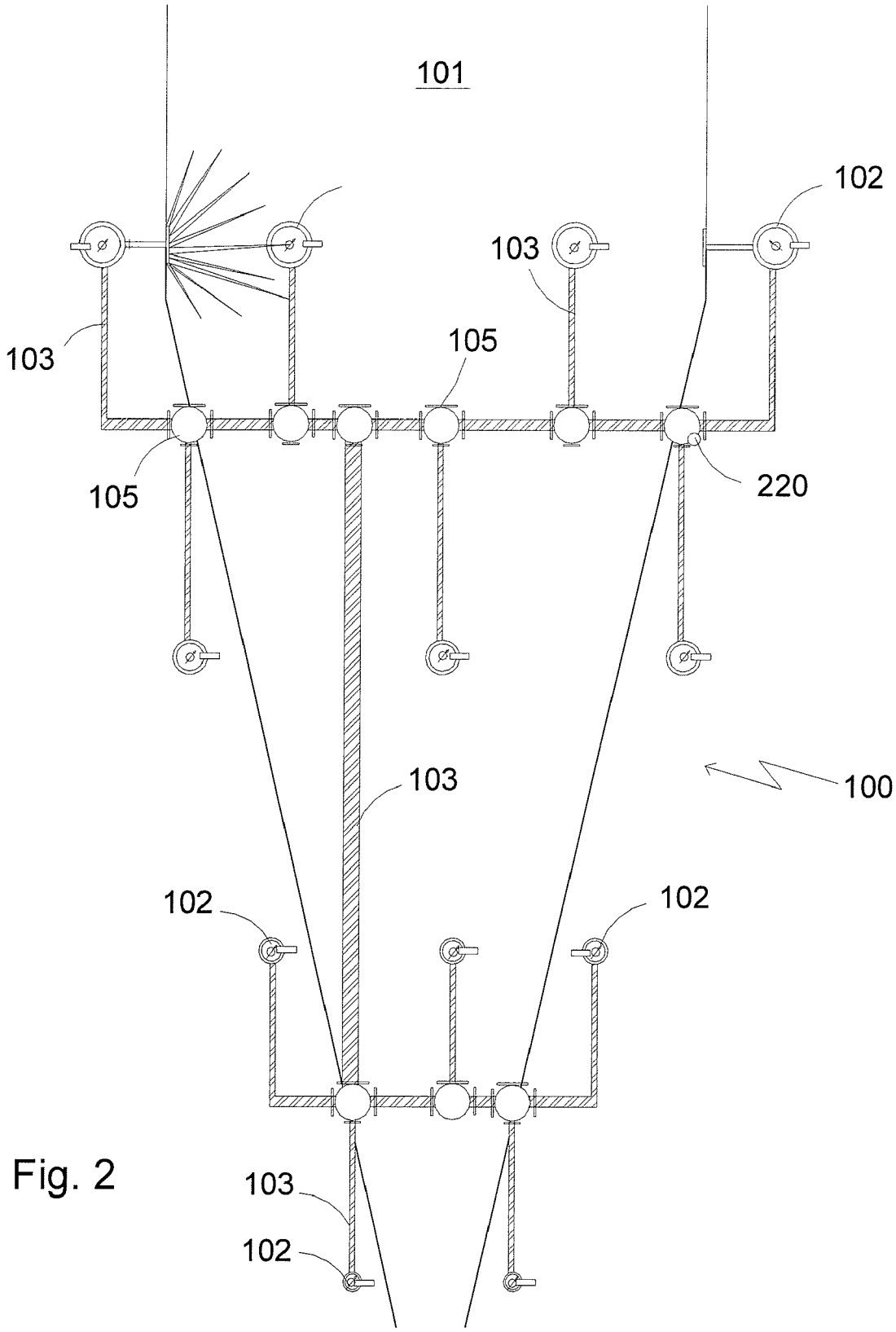
FIG. 2 is a schematic view of an activation and fluidification system according to the present invention.
Figure 3:
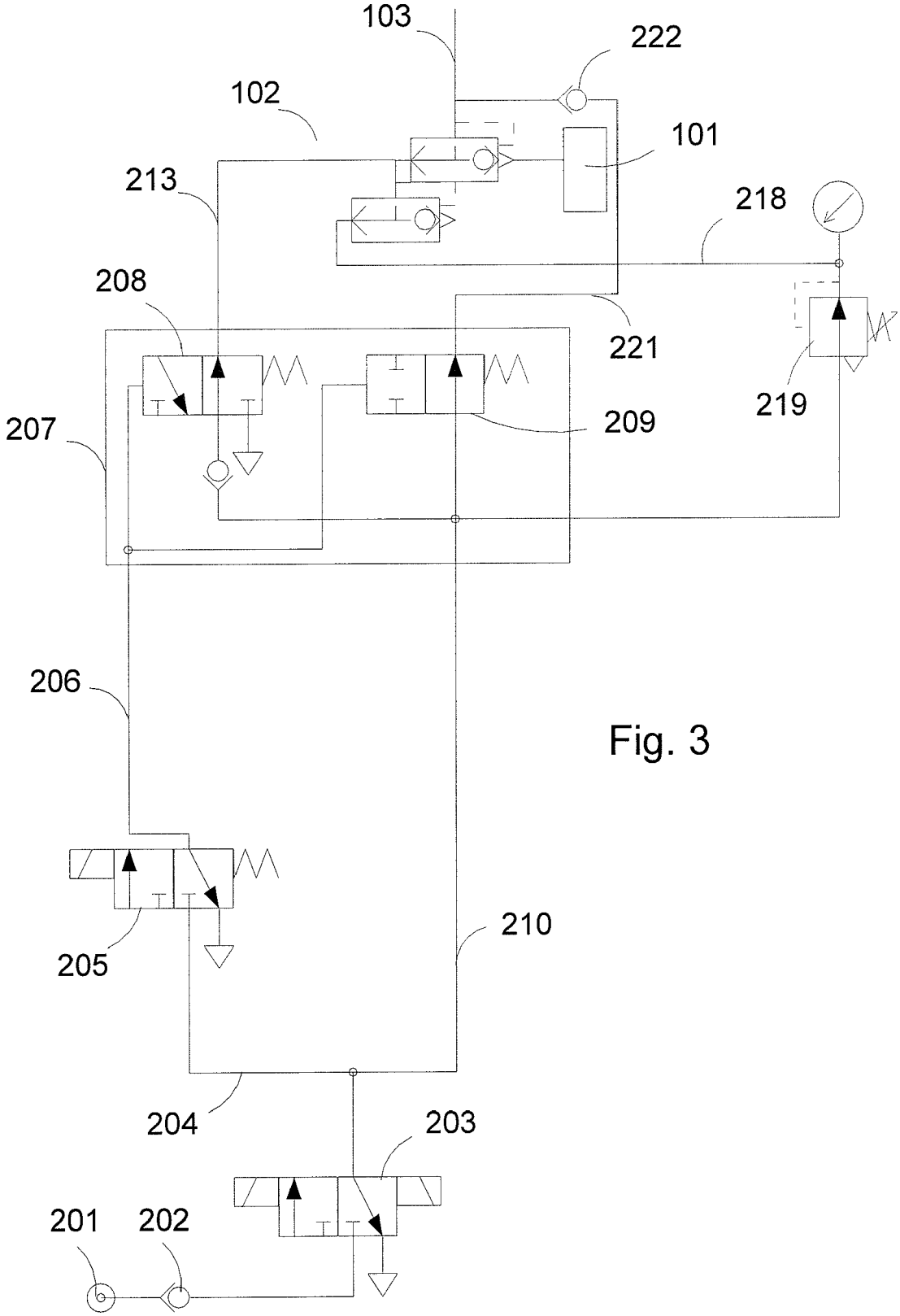
FIG. 3 depicts a first embodiment of a control system for use in the present invention.
Figure 4:
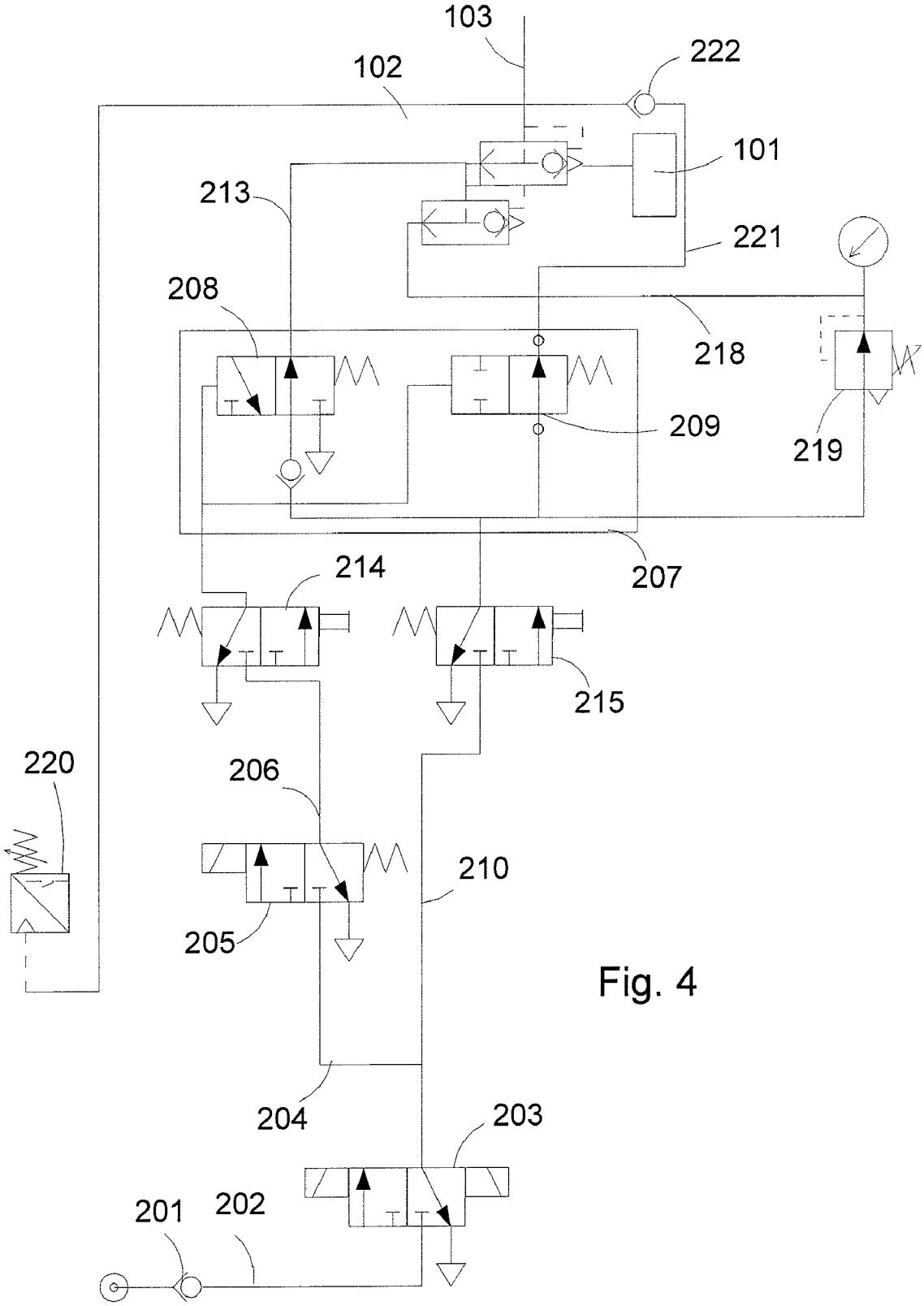
FIG. 4 depicts a second embodiment of a control system for use in the present invention.

The invention will be more apparent from the ensuing detailed description of one embodiment thereof provided by way of non-limiting example and illustrated in the accompanying drawings, in which:

FIG. 1 shows a fine adjustment firing valve able to discharge air into the silo only from the rated operating pressure to a predetermined pressure less than the rated pressure;

FIG. 2 shows an activation and fluidification system for granular material silos or containers according to the invention;

FIG. 3 shows a first embodiment of a control system for the activation and fluidification system for silos;

FIG. 4 shows a second embodiment of a control system for the activation and fluidification system for silos.

With reference to the accompanying figures, these show an activation and fluidification system 100 for granular material silos 101 or containers.

In particular, as shown, a series of fine adjustment firing valves 102, of the type shown in FIG. 1, are applied to the silo 101, they comprising means for limiting the discharge of compressed air on attaining a determined pressure.

According to the invention, a tubular network 103 for storing compressed air feeds each fine adjustment firing valve 102.

Specifically, the tubular network 103 comprises a plurality of tubular elements connected together by respective connection elements 105 known as distribution nodes, this network being connected to a source of compressed aeriform, more preferably compressed air.

These distribution nodes 105 enable the network to be formed according to requirements and ensure compressed air to each valve from several directions.

Advantageously, the tubular storage network 103 is dimensioned such as to ensure maximum power and flow at the inlet to each fine adjustment firing valve 102.

In particular, the rated diameters of the tubular elements of the network 103 can be all equal or can differ according to the valve diameters and the distance of one valve from another.

For example the vertical tubular elements which connect the distribution nodes 105 to the fine adjustment firing valves 102 have the smallest diameters D1, the tubular elements which connect the distribution nodes together have diameters D2 greater than D1, and finally the tubular elements which connect together those distribution nodes of the silo 101 positioned at different height have diameters D3 greater than D2.

Advantageously, the tubular storage network 103 is provided with a distribution node 105 at each fine adjustment firing valve 102, but there is nothing to prevent several connection nodes 105 being provided within the tubular storage network 103 for connection to further fine adjustment firing valves not initially scheduled.

These firing valves 102 can have different firing cross-sections, for example with greater dimensions towards the top of the silo.

A network can therefore be constructed without using reservoirs connected to the valves 102, by connecting them directly to the network 103.

Advantageously, to improve operating safety, a pneumatic control system comprising a multifunctional pneumatic valve 207 is installed on each fine adjustment firing valve 102.

In particular, the compressed air feed source 201 is connected via a unidirectional valve 202 to a discharge valve 203, preferably represented by a conventional double-acting three-way solenoid valve.

The discharge valve 203 is connected by a first conduit 204 to a firing activation valve 205, preferably represented by a conventional three-way solenoid valve with direct operation and spring return.

The firing valve 205 is then connected, via the conduit 206, to operating devices of a multifunctional valve 207. The multifunctional valve 207 comprises a first release valve 208, preferably represented by a conventional three-way solenoid valve with direct operation and spring return, and a second release valve 209, preferably represented by a conventional two-way solenoid valve with direct operation and spring return.

As stated, the firing valve 205 is connected to the operating devices of the first and second release valve of the multifunctional valve 207.

The discharge valve 203 is connected via a feed conduit 210 directly to the second release valve 209, which is connected via the conduit 221 and a unidirectional valve 222 to a tubular element of the network 103.

The valve 102 comprises a first connection to the conduit 213. This connection is the valve firing control. When this conduit 213 is put under atmospheric pressure via the valve 208, the valve 102 fires into the silo.

The valve 102 comprises a second connection to a conduit 218.

The conduit 210 supplies air at rated pressure to a pressure reducer 219 connected to the conduit 218.

The pressure reducer 219 is set to the pressure at which the valve 102 terminates its discharge into the silo. Hence the air in the conduit 218 is at the set pressure of the pressure reducer 219. For example it can be set to a pressure of 8 bar such as to discharge air into the silo only from the rated pressure of 10 bar until it reaches the pressure of 8 bar. A single pressure reducer 219 could be used for several valves, by connecting the conduit 218 to several valves 102.

The valve 102 also comprises a third connection to a tubular element of the network 103.

In response to a firing command, the valve 102 connects the third connection to the silo, via a fourth connection. Advantageously according to the invention, mechanical shutoff valves can be added between the multifunctional valve 207 and the valves 205 and 203.

In particular, a first mechanical shutoff valve 214 is provided in the conduit 206 between the firing valve 205 and the operating devices of the multifunctional valve 207.

A second mechanical shutoff valve 215 is provided in the feed conduit 210 downstream of the multifunctional valve.

Advantageously, the first and second mechanical shutoff valve 214, 215 are operable simultaneously, they being preferably represented by conventional two-way solenoid valves with direct operation and spring return.

Advantageously according to the invention, a single digital pressure transmitter 220 is connected to the firing valve storage network 103, for example to a tubular element of the network 103, to control correct network operation.

In a simplified embodiment, the system could operate with only the feed inlet 201, the firing valve 205 connected to the feed entry 201 and to the operating devices of the first release valve 208, itself connected to the firing valve 102; the feed entry 201 is also connected to the first release valve 208.

The operation of the network according to the invention will now be described.

The network must be initially filled with compressed air from the feed source 201.

Starting from the illustrated configuration, the discharge solenoid valve 203 is energized to connect the feed conduit 210 and hence the conduit 213 to the tubular element of the network 103, by way of the multifunctional valve 207 which is in communication with the feed source 201.

In this manner the network 103 and its tubular elements are at rated operating pressure, typically at about 10 bar.

To implement discharge, if the valve 102 is maintained, the discharge solenoid valve 203 is energized. In this manner the tubular element of the network 103 is in contact with the atmosphere via the conduit 210.

Clearly in the embodiment shown in FIG. 4, the feed and firing step cannot take place until the first and second mechanical shutoff valve 214, 215 are energized.

The presence of these mechanical shutoff valves 214, 215 enables maintenance to be carried out on portions of the tubular network 103 of the invention while preventing loss of material contained in the silo.

For firing, the firing solenoid valve 205 is energized, the air entering from the feed source 201 reaching the operating devices of the multifunctional valve 207 via the conduit 206. A vacuum is created in the conduit 213 which operates the firing valve.

When setting up the system, all the valves 102 are set such as to define the pressure at which the outflow of air to the silo 101 terminates. The firing times are also defined for each valve. A control unit, not shown, handles these functions. Using a single pressure transmitter for the entire network, it becomes possible to continuously monitor the pressure variation within the network as a function of time. Said control unit can also monitor whether each valve fires at the required time and whether the set pressure is respected. This considerably simplifies system control.

The firing valve 102 is controlled by the presence of vacuum in the conduit 213.

In a network in which the multifunctional valve 207 is absent, the valve cannot be controlled from a distance of more than about ten metres from the valve, otherwise the vacuum (the command) is insufficient to operate the valve, or firing takes place with a delay and a duration not effective for the purpose.

Again if the multifunctional valve 207 is absent, any separation, fracture or other accident to the control conduit 213 can lead to accidental firing, with the dangers which can derive therefrom.

By arranging the multifunctional valve 207 in the vicinity of the valve 102, the conduit 213 is of negligible length and can be easily protected from external accidents. The conduit 213 can be advantageously formed by integrating it into the valve 102.

The firing conduit formed with the solenoid valve 205 can then be positioned even at a considerable distance without pressure loss. The conduit 206 now becomes the firing command conduit, operating at rated feed pressure.

With the present system all the compressed air reservoirs present in the known art are eliminated and replaced by a compressed air tubular storage network dimensioned such as to be able to maximize power and flow at the point of greatest consumption.

Hence generalizing, the largest tubular elements are present at the valves of largest rated diameter. For example, with valves of 150 DN rated diameter, tubular elements of diameter 150 are used.

By using only the pressure for example between 10 bar and 7 bar instead of between 10 bar and 0 as in the known art, an enormous energy saving is achieved.

In the known art, with 150 l of air available at a pressure of 10 bar, 150×10=1500 nl (normal litres) of air are used.

According to the present invention (with the valve set at 7 bar) only 150×(10−7)=450 nl are used.

This represents a saving of 1050 nl for each valve used.

The invention claimed is:

1. An activation and fluidification system for a silo or container for containing granular material, comprising a plurality of fine adjustment firing valves each fine adjustment firing valve comprising a feed entry for a pressurized aeriform; a firing valve connected to said feed entry; said firing valve being connected to operating devices of a first release valve; said first release valve being connected to said fine adjustment firing valve; said feed entry also being connected to said first release valve; such that when in its rest position said fine adjustment firing valve is fed with a pressurized aeriform, whereas when in its firing position said fine adjustment firing valve is connected to atmosphere; said system further comprising means for limiting the discharge of a pressurized aeriform from an initial pressure to a predetermined final pressure lower than said initial pressure when connected to said silo or container, said system comprising a tubular network for storing said pressurized aeriform at said initial pressure, and to which said plurality of fine adjustment firing valves are connected.

2. A system as claimed in claim 1, wherein storage reservoirs for said pressurized aeriform are not directly connected to each of said fine adjustment firing valves.

3. A system as claimed in claim 1, wherein said tubular network for storing said pressurized aeriform comprises distribution nodes.

4. A system as claimed in claim 1 wherein said tubular storage network is dimensioned such as to ensure maximum power and flow at an inlet to each fine adjustment firing valve.

5. A system as claimed in claim 1, wherein each fine adjustment firing valve also comprises a discharge valve, positioned downstream of said feed entry from which the connections to said firing valve and to said first release valve branch; said discharge valve also being connected to a second release valve; said firing valve also being connected to operating devices of said second release valve; said second release valve being connected to said tubular network.

6. A system as claimed in claim 5, wherein each of said plurality of fine adjustment firing valves comprise, for setting said predetermined final pressure, a pressure reducer connected between said discharge valve and said fine adjustment firing valve.

7. A system as claimed in claim 6, wherein each fine adjustment firing valve also comprises a first mechanical shutoff valve positioned between said firing valve and said first release valve; and a second mechanical shutoff valve positioned between said discharge valve and said second release valve.

8. A system as claimed in claim 1, further comprising a single digital pressure transmitter connected to said tubular storage network.

9. A system as claimed in claim 1, wherein each said plurality of fine adjustment firing valves comprises adjustment means for adjusting the value of said predetermined final pressure.

* * * * *